358-140

3/4/86 XR 4,574,279 SR

United States Patent [19]

Roberts

[11] Patent Number: 4,574,279

[45] Date of Patent: Mar. 4, 1986

[54] VIDEO DISPLAY SYSTEM HAVING MULTIPLE SELECTABLE SCREEN FORMATS

[75] Inventor: Kenneth B. Roberts, Houston, Tex.

[73] Assignee: Compaq Computer Corporation, Houston, Tex.

[21] Appl. No.: 438,975

[22] Filed: Nov. 3, 1982

[51] Int. Cl.[4] ..... G09G 1/16

[52] U.S. Cl. ..... 340/731; 340/748; 340/745; 358/140

[58] Field of Search ..... 358/140; 340/728, 731, 340/721, 745, 747, 744, 748, 750

[56] References Cited

U.S. PATENT DOCUMENTS

| | | | |
|---|---|---|---|
| 3,999,168 | 12/1976 | Findley et al. | 340/731 |
| 4,107,664 | 8/1978 | Marino | 340/731 |
| 4,283,724 | 8/1981 | Edwards | 340/731 |
| 4,365,270 | 12/1982 | Rutishauser | 358/140 |
| 4,400,717 | 8/1983 | Southworth et al. | 358/140 |
| 4,455,572 | 6/1984 | Malden | 358/140 |

OTHER PUBLICATIONS

Hewlett-Packard Journal; Apr. 1978 (Re: Model HP-9845A Desktop Computer).

*Primary Examiner*—Marshall M. Curtis
*Attorney, Agent, or Firm*—T. Gordon White

[57] ABSTRACT

A video display system having two different selectable screen formats for displaying images in a display field is disclosed. The system includes circuitry for switching from a first screen format defining a display field of a first number of horizontal scan lines to a second screen format having a second number of scan lines, where the height and width of the display field remains the same for both screen formats. The first and second screen formats are generated, respectively, from first and second horizontal scan frequencies, which frequencies differ significantly from format-to-format. The system further includes adjustment circuitry for adjusting the height of the display field to remain the same for each screen format.

16 Claims, 17 Drawing Figures

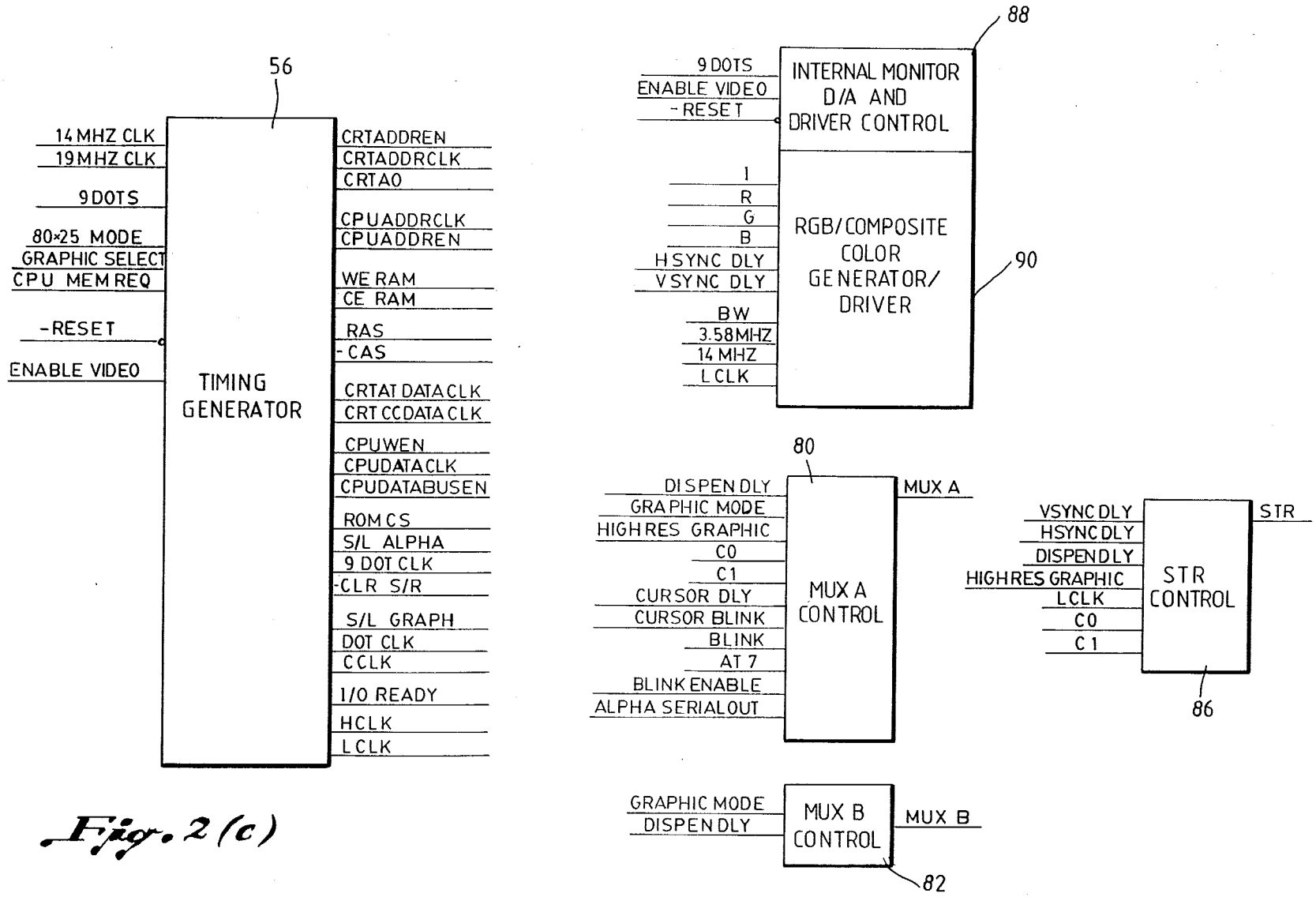
Figr. 2 (c)

CC6
CC4
CC2
CCØ
DO6
DO4
DO2
DOØ
CO
CC7
CC5
CC3
CC1
DO7
DO5
DO3
DO1
C1
DOØ-DOØ7
DOØ
DO6
-CRTATDCLKQ
ATØ
AT6
CC7
E2
E
R
-9
DOTS
DOØ
DO7
-CRTCCD
CLKQ
CCØ
CC7
-9DOTS
RA2
RA1
RAØ
-RESET
DO7
-EE
E PROM
ROM
CC7
VIDEO EN
AL
DOT
+5

NC
+12
VIDEO JACK
CHASSIS GND
GND
CHASSIS GND
C49
51Ω
R10
R11
100
Q1
+5
R8
13K
R6
R5
R4
5.6K
R9
R12
3.3K
R13
2.2K
R7
51Ω
R40
R41
R39
220(3)
470pf (6)
C45
C44
C48
C47
C46
C43
9-DIN D-TYPE
CONNECTOR
JACKET
C42
CHASSIS
GND
-VSQD
HSQD
HJFREQD
-BLANK
-VSQ
HSQ
9DOTSUPQ
-HSOVS
B
G
I
R
E6
9DOTSUPQ
CSQ
MIX VIDEO
E4
-VSQ
VSQ
HSQ
-HSQ
E5
Ø4
Ø4

VIDEO DISPLAY SYSTEM HAVING MULTIPLE SELECTABLE SCREEN FORMATS

BACKGROUND OF THE INVENTION

This invention relates to video display systems. More particularly, this invention relates to a video display system for use with a personal computer for displaying text characters or graphic symbols on a CRT display in selectable screen formats, where the display fields for each selected format is the same size.

The techniques of displaying alphanumeric characters or graphic symbols on a CRT screen is well known in the art. Raster scan video display units have horizontal and vertical scan or sync frequencies for controlling the position of the electron beam(s), which is, in turn, modulated to create the image on the CRT screen. The images are displayed in a display field comprising some determined number of horizontal scan lines. Each horizontal scan line in the display field is divided into a number of pixel locations, or dots. The display field will consist of an array of Y by X dots, where Y is the number of dots on each horizontal scan line across the display field and X is the number of scan lines up and down the field. For example, a common display field would be 640×200 dots.

Control of the number of horizontal scan lines in the display field, i.e., the height of the display field is under control, for the most part, of the vertical scan frequencies. The height adjustment control of the CRT video display also affects the height of any image displayed on the screen.

Within this array of dots forming the display field, a typical prior-art video display system operating in the text or alphanumeric display mode subdivides the display field array into a determined number of alphanumeric character cells. A character cell could, for example, be an array of 8×8 dots, where each character is actually produced from a 7×7 dot matrix centered inside a character cell, thus leaving a 1 dot space between each character in the displayed field. For a display field of 640×200 dots and a character cell of 8×8 dots, it is possible to display 25 lines of text of 80 characters per line. A display field of 25 lines of 80 characters created from a 640×200 dot array represent what is hereinafter referred to as a screen format.

Different screen formats can be specified to obtain different results. For example, a color graphics display created on a color CRT monitor from 8×8 character cells in a 640×200 dot display field may create a color display that is pleasing to the eye with good color quality and resolution. However, the 8×8 character cell is not the most desirable display size for alphanumeric characters because the characters are not as well formed as where the character cell comprises more dots. It is known that a character cell formed from a 9×14 dot array offers a far superior optical display of text characters because of the size and sharpness of each formed character and because each character can be more completely formed.

For the most part, however, prior-art video display systems come with only one screen format capability. For example, the IBM personal computer provides a black and white monitor for its alphanumeric display with a 720×350 dots display field, and a separate color monitor for its color graphics with a 620×200 dots display field. This single screen format capability in a single monitor results from the need to precisely maintain many separate frequency signals to the display control circuitry in order to create a displayed image, i.e., the horizontal sync frequency, the vertical sync frequency, the dot clock for timing the output of the video signals for each dot displayed, etc. The frequency of these signals bear close relationships in order to display in a display field a particular screen format. Additionally, a black and white monitor (actually a green and black display, P39 phospor) provides better contrast for the alpha mode.

There have been attempts in the prior art to provide selectable screen formats in a single video display system. For example, in the case of a 640×200 dot display field, it is possible to change the number of lines in the display field by dividing the number of scan lines in half to obtain a display field that is 320×200 dots, where each dot in this field is 2 dots thick. This format can be obtained without changing the horizontal or vertical scan frequencies.

Another way to obtain a different screen format without having to change the scanning frequencies is to double the number of horizontal scan lines by interleaving horizontal scan lines. That is, after each vertical retrace, the position of all of the horizontal scan lines are indexed one-half of the normal scan lines separation, and for these lines displaying new information. The next vertical retrace causes the lines to return their previous positions. In this manner, twice as many lines can be obtained in the display field without changing the horizontal or vertical scan frequencies. However, this approach results, in most cases, in an unacceptable flicker of the display because of the slower refresh of each horizontal scan line.

These prior-art video display systems which have attempted to provide selectable different screen formats in a single monitor, operate on the frequencies and video control timing signals to obtain binary relationships therebetween. For example, in the case of changing from a 640×200 dot display field (80 characters per line of text) to a 320×200 dot field (40 characters per line of text), the number of horizontal scan lines is divided by 2. Similarly, in increasing the number of lines of the 640×200 dot display field (graphics) to a 640×400 dot display field (graphics) requires that the number of lines be multiplied by 2.

A binary relationship, however, does not exist between, for example, a 640×200 dot display field graphics or alpha) and a 720×350 dot display field (alpha only). A 720×350 dot display field using a 9×14 dot character cell will display 25 lines of 80 characters in a manner similar to the 8×8 dot character cell in the 640×200 dot display field discussed above, but with a significantly different field width and height if the timing frequencies, i.e., the horizontal and vertical scan frequencies, were to remain the same as was the case in the prior-art video display systems.

Accordingly, it would be advantageous to provide a video display system having the capability of automatically selecting and displaying multiple screen formats in the same display field size on the same or a separate video monitor when the number of horizontal lines and dots per line are not related by binary multiples, and to do so without the need of any external adjustments at the time of selecting.

SUMMARY OF THE INVENTION

In accordance with the present invention, a video display system having multiple selectable screen formats is disclosed. The display system includes a means for switching from a first screen format defining a display field of a first number of horizontal scan lines to a second screen format having a second number of scan lines where the height of the display field remains the same when the first and second number of horizontal scan lines differ by a nonbinary multiple.

In a narrower aspect of the invention, a video display system responsive to mode select signals for displaying alphanumeric or graphic characters in a display field of a video CRT screen is disclosed. The CRT video screen operates from horizontal and vertical scan frequencies. The height of the display field in the video screen is determined by the screen format selected for displaying the characters where the selected screen format includes a number of horizontal scan lines.

The system includes a means responsive respectively to first and second mode select signals for selecting a first screen format having a first number of horizontal scan lines and a second screen format having a second number of horizontal scan lines. The height of the display field thus formed for both the first and second screen formats is the same when the first and second number of lines are nonbinary multiples of each other.

The means for selecting the screen format further includes a means responsive to a third mode select signal to double the number of lines in the display field without increasing its height by interleaving the horizontal scan lines and keeping the horizontal scan frequency the same.

Each horizontal scan line in the display field for a selected screen format has a width which includes a number of pixel dots. The selecting means includes a dot clock generator responsive respectively to the first and second mode select signals for generating first and second dot clocks. The dot clocks are for outputting a first number of pixel dots per horizontal scan line in the first screen format and a second number of pixel dots per horizontal scan line in the second screen format where the width of each horizontal scan line for both said first and second screen formats is the same.

Each horizontal scan line in either said first or second format, when displaying alphanumeric characters, displays the same number of characters per scan line. Each character appears in a determined array in $n \times m$ dots where the array is formed from n consecutive dots taken along a horizontal scan line for m consecutive scan lines.

The means for selecting the screen formats further includes a means for generating the first vertical scan frequency for the first screen format and a second vertical scan frequency for the second screen format. A means for automatically adjusting the height control for the CRT screen is also included. The height adjustment means responds to the mode control signal to automatically adjust the height control. The vertical scan frequency generating means and the height adjustment means cooperate together to control the height of the display field to be the same for each selected screen format.

The video system further includes a means for generating a first horizontal scan frequency for the first screen format and a second horizontal frequency for the second screen format. Each horizontal scan line is controlled by the period of its respective horizontal frequency. A portion of each horizontal scan frequency period is used to display the video in the display field. The selecting means controls the ratio of the horizontal scan frequency period to the video display time for each horizontal scan line in both said first and second screen formats to be the same.

BRIEF DESCRIPTION OF THE DRAWINGS

For a fuller understanding of the present invention, reference should be had to the following detailed description taken in conjunction with the drawings in which:

FIG. 2(*b*) is a functional block diagram of a different portion of the video controller shown in FIG. 1 and includes the character ROM 68 and the color encoder 84;

FIG. 2(*c*) is a functional block diagram of the remaining portions of the video controller shown in FIG. 1 and includes the timing generator 56, FIGS. 2(*a*), 2(*b*), and 2(*c*), when FIG. 2(*b*) is placed to the right of FIG. 2(*a*), forms FIG. 2 which illustrates the complete functional block diagram of the video controller as shown in FIG. 1;

Similar reference numerals refer to similar parts throughout the several views of the drawings.

DETAILED DESCRIPTION OF THE PREFERRED EMBODIMENT OF THE INVENTION

Figure 1:
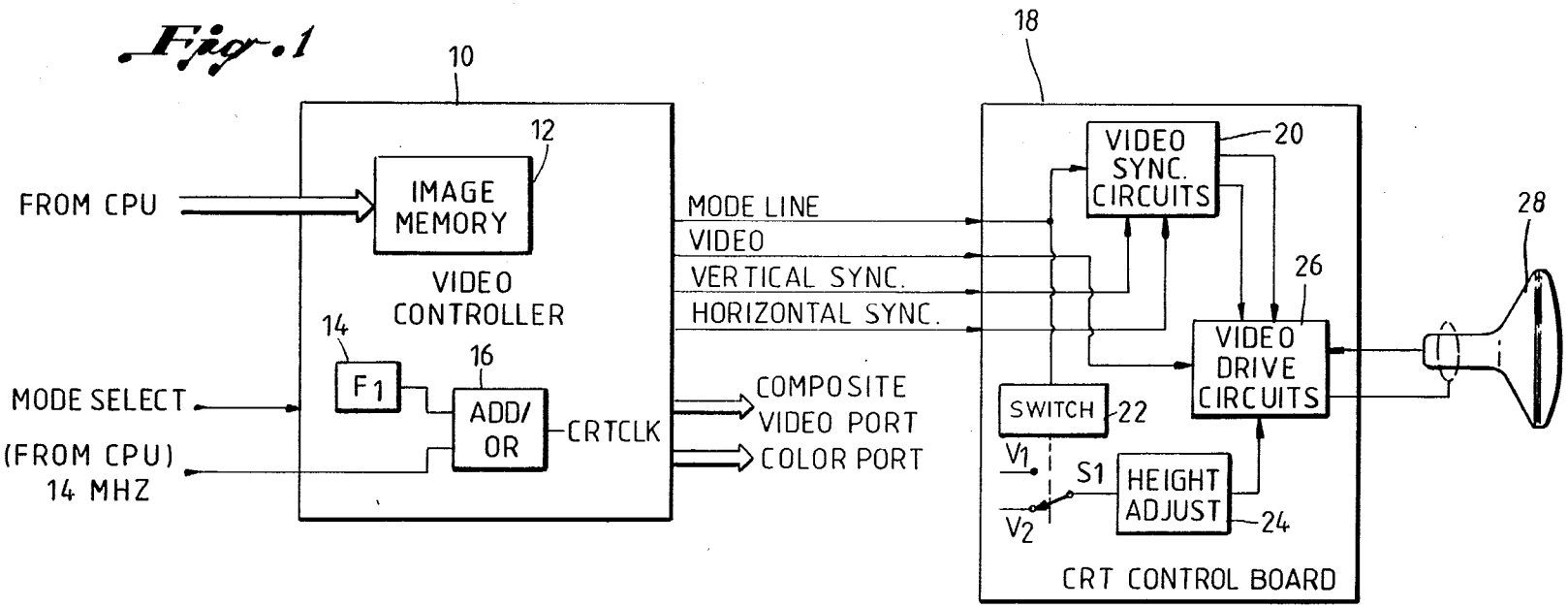
FIG. 1 is a functional block diagram of the video display system of the present invention showing the video controller and CRT control board for generating a video display.

Turning now to the figures and first to FIG. 1, there is shown a functional block diagram of the video display system of the present invention. The video display system shown in FIG. 1 is comprised of video controller 10 coupled to a central processing unit by address and data buses for data transfer therebetween. The video controller 10 appears as an addressable peripheral via an I/O port to the CPU. Other timing signals from the system may also be inputted into the video controller 10, such as the 14 MHz external timing frequency oscillator signal.

The video controller 10 is coupled to a CRT control board 18 which is associated with a CRT video screen 28. The primary function of video controller board 10 is to generate the necessary timing signals to the CRT control board 18 to display in a display field either alphanumeric or graphic information in a format selected in response to mode select signals from the CPU.

In other words, multiple selectable screen formats can be chosen to create displays on CRT 28.

A more detailed description of the functions of the controller board 10 are provided below, but basically, an image memory 12 is provided for receiving image generating data from the CPU, either in the form of dot information for graphics or as addresses to a character generator for creating alphanumeric characters in the display field. A mode select signal is applied to the video controller 10 to select one of two possible screen formats, either high resolution alphanumeric character generation or high resolution color graphics.

Still referring to FIG. 1, the CRT control board 18 is shown containing circuits for generating the drive signals to control the raster of the CRT display 28. For example, video sync circuits 20 for generating the horizontal and vertical sync signals to the video drive circuits 26 are included. One feature of the CRT control board 18 is a height adjustment circuit 24 which applies a control voltage to the video drive circuits to provide a small amount of control of the height of the image displayed on the screen of CRT 28. As will be described below, a switch circuit 22 is provided for selectively applying one of two height adjustment voltages to the height adjustments circuits 24, depending on the mode or screen format that has been chosen for the current display.

Multiple Screen Formats

In accordance with the present invention, a video display system is disclosed having the capability of selecting between different screen formats where the number of dots per horizontal scan line and the number of scan line in a display field from format-to-format are not related by some binary multiple. As has been discussed above, where the different screen formats differ as a binary multiple, it is possible to obtain different screen formats without having to change the horizontal and vertical timing signals applied to the raster CRT scan.

Some personal computer video display systems, such as the IBM personal computer display system, provide two monitors, one for displaying high resolution alphanumeric characters and another for displaying high resolution color graphics. For the high resolution alphanumeric video display, a display field of 720×350 dots is provided for displaying 25 lines of text with 80 characters per line where each character is created from a 9×14 dot character cell. A 9×14 dot character cell enables each of the alphanumeric characters to be formed completely for excellent visual appeal and readability. This high resolution display field is normally not used to achieve high resolution color graphics because of the higher scan frequency required to achieve this screen format.

In the case of the IBM personal computer, a separate color video monitor is provided for displaying color graphics. For this monitor, a 640×200 dot display field is provided. With this size display field, 25 lines of 80 characters per line of alphanumeric display is possible using an 8×8 character cell. Of these 8×8 dots character cells, only a 7×7 dot array is used to form each character. Accordingly, this high resolution color graphics display field produces a low resolution alphanumeric display resulting from the fact that some of the monitors cannot operate at these higher dot frequencies.

A subset of the high resolution color graphics display screen format when displaying alphanumeric characters is a low resolution alpha system in which only 25 lines of 40 characters per line are provided.

In other words, the display field is reduced to 320×200 dots with the alphanumeric characters formed in an 8×8 dot matrix where each dot is doubled in size over the resolution for the display field having 640×200 dots. For both the 640×200 dot display field and 320×200 dot display field, it is possible using the interleaving technique to increase the number of scan lines to 400 lines without having to modify the vertical or horizontal scanning frequencies. This of course results in a slower refresh time for the horizontal lines, and may result in flickering in the display.

The high resolution alphanumeric screen format does not represent a binary multiple from the number of scan lines and number of dots per line for the high resolution color graphics screen format. It is not possible, therefore, to select between these two screen formats and have the display field on the CRT 28 remain the same size if the horizontal and vertical scanning frequencies remain unchanged.

Thus, in accordance with the present invention, a means is provided for selecting and generating the proper horizontal and vertical timing frequencies, along with other adjustment controls, to enable the video display system of the present invention to select between these two screen formats in response to mode select signals from a CPU while maintaining the screen size the same.

Timing Considerations

One of the objects of the present invention is to enable the selection of two screen formats while maintaining the height and width of the display field the same for both formats. In other words, the high resolution, alphanumeric screen format, where each character is formed from a 9×14 dot character cell with 25 lines of 80 characters of text per line will be the same size as the 25 lines of 80 characters formed from 8×8 dot character cells in the high resolution color graphics screen format.

For purposes of the following discussion, assume that the high resolution color graphics display field of 640×200 dots is a first screen format and the high resolution alphanumeric screen format for a 720×350 dot display field in a second screen format. For the first screen format, 200 scan lines of 640 dots per line will define the size of the display field that is to be kept constant regardless of the screen format selected. For the first screen format, a horizontal scan frequency of approximately 15.7 KHz and a vertical sync frequency of approximately 60 Hz is selected. (The actual implementation of the first screen format by the present invention yields a slightly smaller frequency from these frequencies (See TABLE 1).)

The following TABLE 1 illustrates the various timing frequencies and time intervals which control the generation of the first screen format video display.

TABLE 1

| | 40 × 25 Alpha | 80 × 25 Alpha | 320 × 200 Graphic Mode |
|---|---|---|---|
| Dot Clock | 7.15909 | 14.21818 | 7.15909 |
| ÷ dots/character | 8 | 8 | 8 |
| = Character Clock | 894.88 KHz | 1.7897725 | 894.88KH |
| ÷ Chara/Scan line | 57 | 114 | 57 |

TABLE 1-continued

| | 40 × 25 Alpha | 80 × 25 Alpha | 320 × 200 Graphic Mode |
|---|---|---|---|
| [Nht + 1] = HSYNC | 15.699759 KHz | 15.699759 KHz | 15.699759 KHz |
| ÷ (Scan lines/ Chara Row)* (Data Rows) + Vertical adj [(Nr + 1)(Nve + 1) + Nadj] = VSYNC | 262 | 262 (8)(32) + 6 | 262 (2)(128) + 6 |
| | 59.922 Hz | 59.922 Hz | 59.922 Hz |
| Character Time Tc | 1.117 | 558 | 1.117 |
| Raster Period TR TR = (Nht + 1) Tc | 63.69 | 63.69 | 63.69 |
| Vert Sync Pulse Width Tvsw Tvsw = 16 Tc | 1042 ms | 1019 | 1042 ms |
| Horiz Blank Internal THBI THBI (Nht + 1 − NHSP) · Tc | 18.992 | 18.992 | 18.992 |
| Horiz Sync Pulse Width Thsw THSW = Nhsw Tc | 5.59 | 5.59 | 5.59 |
| Character Box | 8 × 8 | 8 × 8 | |
| Character | 7 × 7 (double dotted) | 7 × 7 | |

For the presently preferred embodiment of the invention, each horizontal scan line across the CRT 28 is divided into a possible 114 character time intervals. Of these 114 character time intervals, only a maximum of 80 character intervals will be used in the width of the display field. It is possible, however, to reduce the number of characters displayed to 40 but displayed the same display field width, with each character being double dotted over the resolution available in the 80 character display. In other words, in the first screen format of 640×200 dots in the display field, 25 lines of 80 characters will be displayed. By halfing the dot clock, which is outputting the dot information, it is possible to create a display field in which there are 25 lines of 40 characters or a screen size of 320×200 dots (See TABLE 2).

For the second screen format, a different horizontal sync frequency is required, one that is higher than for the first screen format, in order to obtain the 720×350 dot array display field with the characters formed from 9×14 dot character cells. The derivation of the horizontal sync frequency for this second screen format was derived by beginning with a horizontal sync frequency available in a standard off-the-shelf monitor for such a high resolution video display system, for example, 18.43197 KHz.

While the number of horizontal scan lines contained in the video display is 350 scan lines, there are in fact a total of 370 horizontal scan lines sweeped across the video CRT 28. Since the object of the invention is to maintain the same display field for both screen formats, whatever horizontal scan frequency is chosen for the second screen format, practical considerations of the required dot clock frequency to read out the dot information to generate the displayed characters, and of the required vertical sync frequency must be taken into account. In other words, the horizontal sync frequency controlling the horizontal scan line must not be too high in frequency, otherwise the dot clock derived therefrom will exceed the maximum rate at which the digital circuits can reliably operate to output the digital information for the dots to be displayed. For example, an 18.43197 KHz horizontal scan frequency results in a dot clock of 18.911204 MHz ((18.43197 KHz)·(114)·(19) = 18.911204 MHz), which has a large number of significant digits.

It was observed that by trying different horizontal sync frequency slightly above and slightly below the 18.43197 KHz value, that 18.4 KHz yielded the best results. For this horizontal scan frequency, the dot clock is equal to 18.8784 MHz. For a given horizontal scan frequency, the vertical sync frequency can be obtained by dividing the horizontal scan frequency by the number of horizontal lines, or in the case of the second screen format 370. The vertical sync frequency thus obtained for a horizontal scan frequency of 18.4 KHz is 49.73 Hz. Knowing that the vertical sync circuits of the CRT control board 18 are capable of syncing on frequencies from 50 to 60 Hz, the present invention has chosen a vertical synchronization frequency of 50 Hz from which the dot clock and the horizontal sync frequency are obtained, respectively of 18.981 MHz and 18.5 KHz.

The lower vertical synchronization frequency of 50 Hz from the 60 Hz for the first screen format was chosen in order to increase the height of the display field. Even with a higher horizontal scan frequency, a flattening of the display field would occur if the vertical scan frequency for the first screen format were kept unchanged, even though there are more horizontal scan lines in the second screen format, 350, than were in the first screen format, 200.

The following TABLE 2 illustrates the timing frequencies and intervals for generating the high resolution alphanumeric display of the second screen format, and the high resolution color graphics and the low resolution character displays of the first screen format. Also illustrated in TABLE 2 is the timing for the interlaced mode graphics option for increasing the number of horizontal scan lines in the display field without having to effectively change the horizontal and vertical timing frequencies for the selected screen format.

TABLE 2

| | High-Resolution AC Phanumeric (720 × 350 dot display field) | High-Resolution Color Graphics, Low Resolution Alpha (640 × 200 dot display field) | Low-Resolution Color Graphics, Low Resolution Alpha (320 × 200 dot display field) | Interlace Mode |
|---|---|---|---|---|
| Display Characterisitics | | | | |
| Dot Clock | 16.257 MHz | 14.31818 MHz | 7.15909 MHz | 16.107953 MHz |
| Chara. Matrix | 7 × 9 | 7 × 7 | 7 × 7 | 7 × 10 |
| Chara. Block | 9 × 14 | 8 × 8 | 8 × 8 | 9 × 16 |
| Page Matrix | 80 × 25 | 80 × 25 | 40 × 25 | 80 × 25 |
| Graphics (Pixel) | None | 640 × 200 | 320 × 200 | N/A |

TABLE 2-continued

| | High-Resolution AC Phanumeric (720 × 350 dot display field) | High-Resolution Color Graphics, Low Resolution Alpha (640 × 200 dot display field) | Low-Resolution Color Graphics, Low Resolution Alpha (320 × 200 dot display field) | Interlace Mode |
|---|---|---|---|---|
| Horizontal Timing | | | | |
| Horiz. Frequency | 18.43197 KHz | 15.699759 KHz | 15.699759 KHz | 15.699759 KHz |
| Horiz. Timing | 54.25 ms | 63.695 ms | 63.695 ms | 63.695 ms |
| Video Time | 37.93 ms | 44.7 ms | 44.7 msec | |
| Character Time | 474.125 ms | 558.7 ms | 1.117 msec | |
| Horiz. Blanking Interval | 9.965 ms | 18.997 ms | 18.997 ms | 18.997 ms |
| Horiz. Drive Delay | 1.1 ms | 5.587 ms | 5.587 ms | 5.587 ms |
| Horiz. Pulse Width | 8.3 ms | 5.587 ms | 11.17 ms | 5.587 ms |
| Horiz. Scan Delay | .554 ms | 7.823 ms | 2.236 ms | 7.823 ms |
| Vertical Timing | | | | |
| Vert. Freq. (Refresh) | 50 Hz | 59 Hz | 59.923 Hz | 59.923 Hz |
| Vert. Timing | 20.07 ms | 16.688 ms | 16.688 ms | 16.688 ms |
| Vert. Blanking Interval | 1085 ms | 3.95 ms | 3.95 ms | 3.95 ms |
| Vert. Drive Delay | 0 ms | 1.528 ms | 1.528 ms | 1.528 ms |
| Vert. Pulse Width | 868.06 ms | 1.019 ms | 1.019 ms | 1.019 ms |
| Vert. Scan Delay | 217 ms | 1.402 ms | 1.402 ms | 1.402 ms |
| Number Active Scan Lines | 350 | 200 | 200 | 400 Interlace |

Because of the non-binary relationship between the number of horizontal scan lines in the display field between the high resolution alphanumeric and the high resolution color graphics screen formats, it is not possible to totally account for the differences in the display field screen height by changing the vertical sync frequency alone. Accordingly, provision has been made to the CRT control board 18 for automatically adjusting the height adjustment circuits 24 to provide the additional amount of height adjustment needed to keep the display field size the same for both screen formats. This height adjustment voltage is provided by switch S1 (see FIG. 1) which connects two different height adjustment voltages $V_1$ and $V_2$ to the height adjustment circuits 24.

Control of the actuation of selection switch S1 is under control of the MODE LINE from the video controller 10. MODE LINE indicates which of the two screen formats the video display system has selected. Additionally, the mode line shown in FIG. 1 is applied to the video sync circuits 20 to select components to enable the synchronization circuits to sync to the two different horizontal and vertical sync frequencies which are provided to the CRT control board 18 by the video control 10, namely, 18.5 KHz for the high resolution alphanumeric screen format and 15.7 KHz for the high resolution color graphics color format. The operations of the circuits of the CRT control board are well known to those skilled in the art and a more detailed circuit diagram and description in their operations are not being provided here.

In order for the present invention to display 80 characters across the width of the display field in both screen formats, it was required that the percentage of each raster interval (the time between consecutive horizontal sync pulses) used for the actual video display time would have to remain constant. In other words, for 80 characters out of a total of 114 character time intervals, the video period for both screen formats would have to be maintained at a ratio of 80/114, or approximately 70% of the raster time.

For the high resolution color graphics screen mode, the horizontal frequency of 15.7 KHz yields a raster time interval of 63.7 microseconds. Seventy percent of this time period means that the video display period is approximately 44.7 microseconds. In a similar manner, for the high resolution alphanumeric screen format with a horizontal frequency of 18.5 KHz, the video display period is 37.93 microseconds. From these video time intervals, the time required to output each character can be determined. TABLE 2 illustrates the character time and video time for each of the two screen formats.

The Video Controller Board

Figure 2:
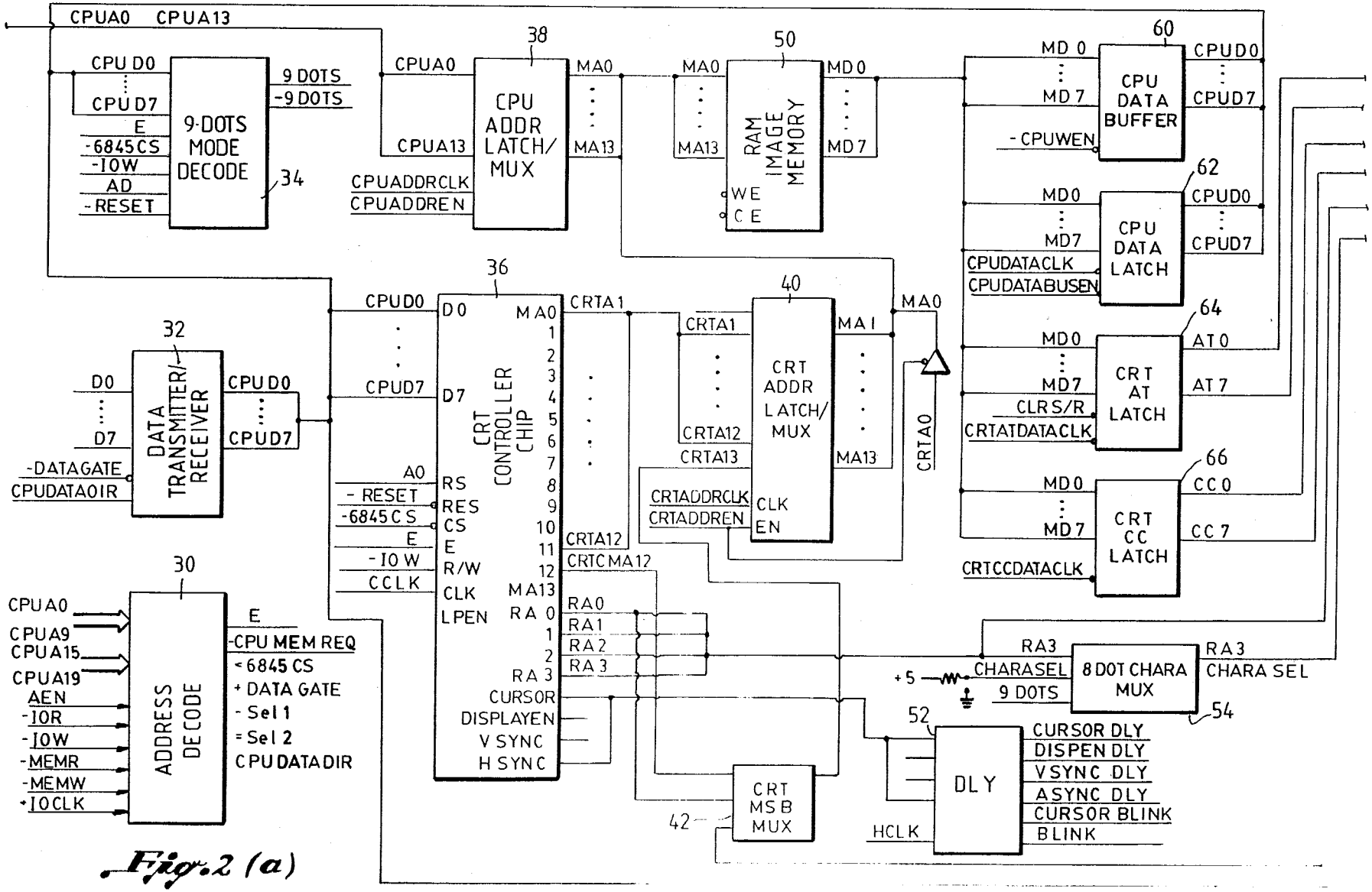
FIG. 2(*a*) is a functional block diagram of a portion of the video controller as shown in FIG. 1, and includes the CRT controller chip 36 and the image memory 50.
Figure 2:
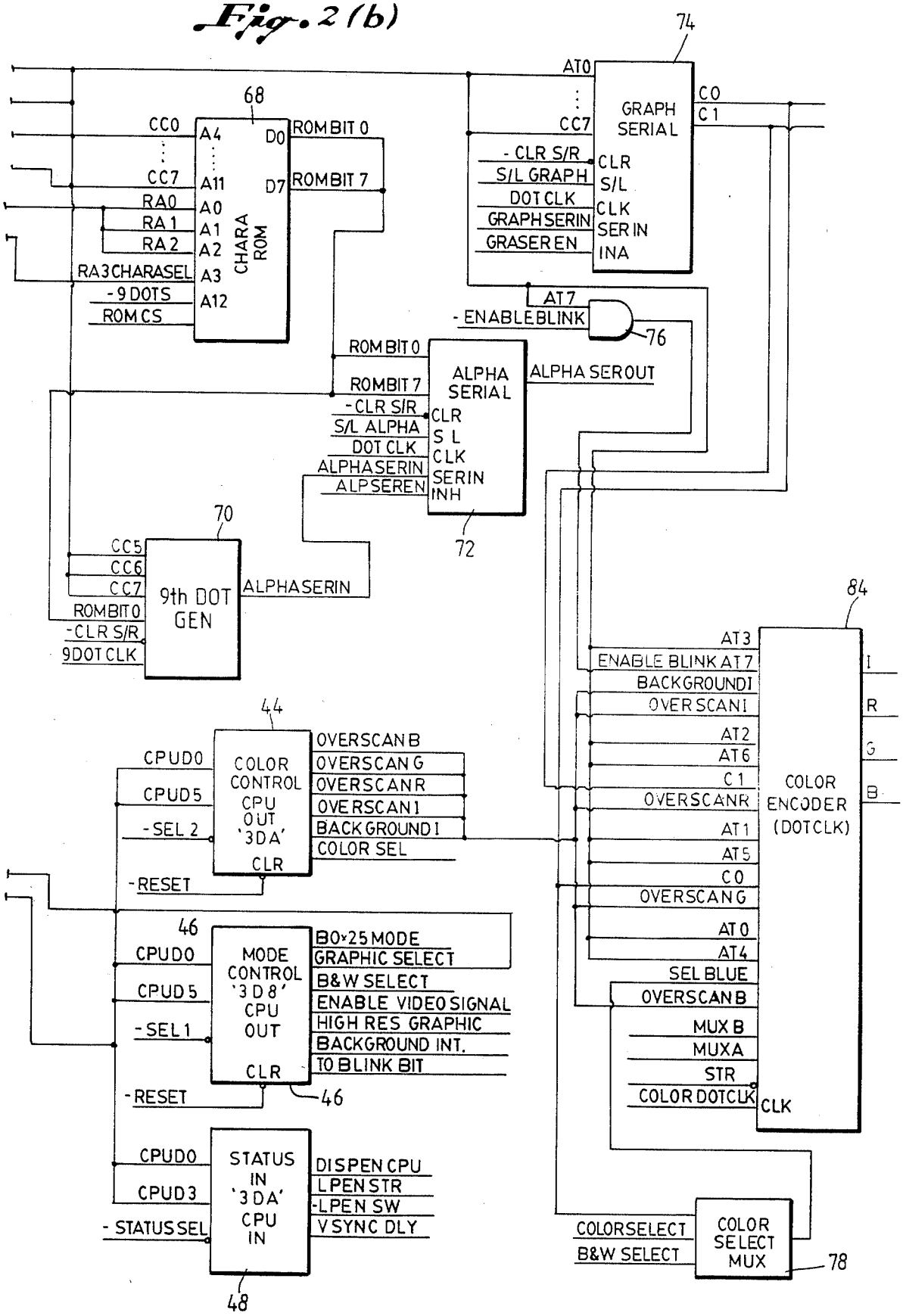

Turning now to FIGS. 2(*a*) 2(*b*), and 2(*c*), which together forms FIG. 2, there is illustrated a functional block diagram of the video controller 12 of FIG. 1 when FIG. 2(*b*) is placed to the right of FIG. 2(*a*). The CPU address bus lines AO–A13 and its data bus lines DO–D7 are shown inputted to both the data transmitter/receiver 32 and the CPU address latch/mux 38. The data transmitter/receiver 32 functions as a directional bus driver for receiving and transmitting data between the video controller 10 and the CPU. The CPU address/mux 38 latches the image memory 50 addresses off of the CPU address bus at the appropriate time under control timing signals from the timing generator 56.

The output from CPU address latch/mux 38 is connected in parallel to the output of CRT address latch/mux 40. Both of these address latch/mux circuits provide addresses to the image memory 50, which contains information concerning the image to be displayed in the display field. In other words, the image memory 50 addresses may come from either the CPU for reading and writing into the image memory or they may come from the CRT controller chip 36, which only reads data out of the image memory 50.

The CRT controller 36 functions to provide the addresses to the image memory 50 and a character generator ROM 68, along with the proper monitor timing signals to create an image on the CRT display 28. For the presently preferred embodiment of the invention, CRT controller chip 36 is manufactured factured by Motorolla as its Model MC6845P. The operations of the CRT controller chip 36 are well known to those skilled in the art in a detailed description of its operations will not be provided here.

Also contained on the video controller 10 is an address decode logic 30 which responds to the CPU address bus AO–A19 to decode various addresses which are applicable to the video controller board 10. In other words, several registers are contained on the video controller 10 which are addressable from the CPU. The color control register 44, the mode control register 46 and the status in register 48 are all addressable from the CPU. The address decode 30 will decode their respective addresses and generate strobe signals which will either strobe data from the CPU into the registers, as in the case of the color control register 44 and the mode control register 46, or to output data from the video controller 10 to the CPU, as in case of status in register 48.

As previously mentioned, the CPU may both read and write to the image memory 50. The address for addressing the image memory 50 from the CPU may be applied through the CPU address latch/mux 38 to the input address of the memory. The output data lines from the memory 50 are applied to CPU data latch 62, which latches the information read out of the image memory 50 and applies it to the data transmitter/-receiver 32 for transmission to the CPU. Data coming from the CPU is applied to the input of CPU data buffer 60 via the data transmitter/receiver 32, and is latched when the CPU write enable signal is generated by the timing generator 56 in response to signals from the CPU.

The address decode 30 also generates a wait signal to the CPU when the CPU is requesting access to the image memory 50 when the video controller is in the process of reading data to the video CRT display 28. This wait signal prevents any contention problem until such time as the image memory 50 is available for the CPU to either write data to or read data from its content. Stated differently, the image memory 50 is available to the CPU on an I/O cycle basis, but it is only available to the video controller monitor 10 circuits on a memory cycle basis, so the CPU must wait until such time as the video controller is not interrogating the image memory 50 for the CPU to gain access thereto.

Still referring to FIGS. 2(*a*), 2(*b*), and 2(*c*), the function of the color control register 44 is to receive from the CPU the color information such as the background color and the palette of colors which are to be used for creating the color graphics display.

The mode control register 46 functions to latch various mode control signals received from the CPU, indicating, among others, whether a graphic screen mode has been selected or whether the alphanumeric screen format has been selected. For the presently preferred embodiment, the high resolution second screen format is detected by the 9-dots mode decode circuit 34 which is connected in parallel to the addressing of the CRT controller chip 36. A register is contained in the CRT controller chip 36 which is programmed with a code indicating that the high resolution alphanumeric format is being selected for the CRT controller. The address for this register is similarly decoded by the 9-dots mode decode circuit 34 to generate the signal 9-DOTS which is used by the circuits of the video controller board 10 in the generation of both screen formats. For example, 9-DOTS is inputted into the timing generator 56 for purposes of controlling the generation of the two different horizontal scan frequencies. The primary function of the timing generator 56 is to generate the various clocking signals required to select and generate the two screen formats. Two different time base frequencies are inputted to the timing generator 56, a 14 MHz CLK for generating the 15.7 KHz horizontal frequency and a 19 MHz CLK for generating the 18.5 KHz horizontal frequency for the high resolution screen format.

Each memory location in the image memory 50 contains two bytes, an attribute byte, which is strobed into the CRT AT latch 64 and a data byte which contains information of the character or pixel to be displayed. The data byte is strobed into the CRT CC latch 66. The output from the CRT CC latch 66 is applied as an address to a character ROM 68 along with a row address from the CRT controller chip 36 when in the character display mode. Together, these address bits create the video data output from ROM 68 to the video display for each of the characters selected. The output lines of the character ROM 68 are applied as the input to the alpha serial circuit 72, which converts the parallel data word into a serial bit stream. This bit stream is then applied to the mux A control 80 whose output is applied to the color encoder 84. Color encoder 84 generates the intensity I, Red R, Green G and Blue B signal lines whose functions are well known to those skilled in the art. The I, R, G, and B data lines are applied to the RGB/composite color generator/driver 90. The RGB/composite color generator 90 creates the appropriate color video signals to a color video monitor, or to a color video TV set.

If the video controller 10 is operating in the graphics mode, the contents of the image memory 50 will be the data to be displayed rather than an address to the character ROM 68. For this mode, the outputs from the CRT AT latch 64 and the CRT CC latch 66 are applied to the graph serial converter 74. The information loaded into the serial converter 74 is outputted in 2-bit pairs, CO and C1, which are in turn applied to the color encoder 84 and the mux A control 80. These 2-bit pairs are used to specify whether the background or one of the colors from the palette of colors will be generated in the color display.

The video controller 10 also includes its own internal monitor circuit 88 which responds to the horizontal and vertical frequencies developed by the timing generator 56 and the mode control signals 9-DOTS to generate the control signals to the CRT control board 18 shown in FIG. 1. For example, the control lines from the video controller to the CRT control board, such as the mode line, video, vertical sync, and horizontal sync, are generated by the internal monitor circuits 88.

Figure 3:
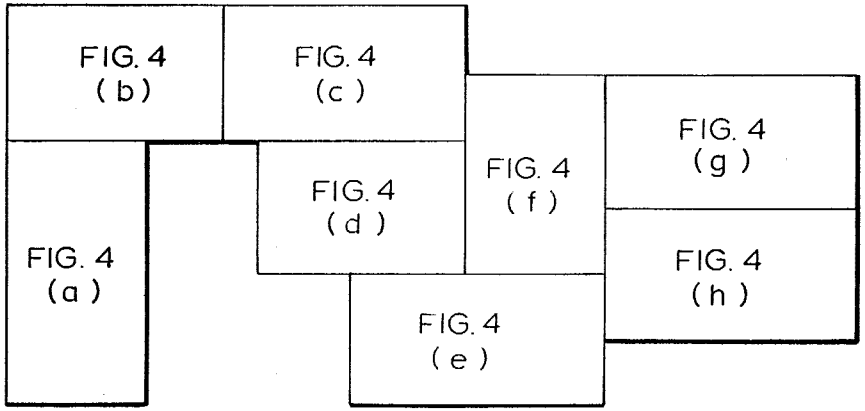
FIG. 3 is a diagram illustrating how to position FIGS. 4(*a*)–(*h*) to form a detail circuit diagram of the internal monitor of the present invention.
Figure 4A:
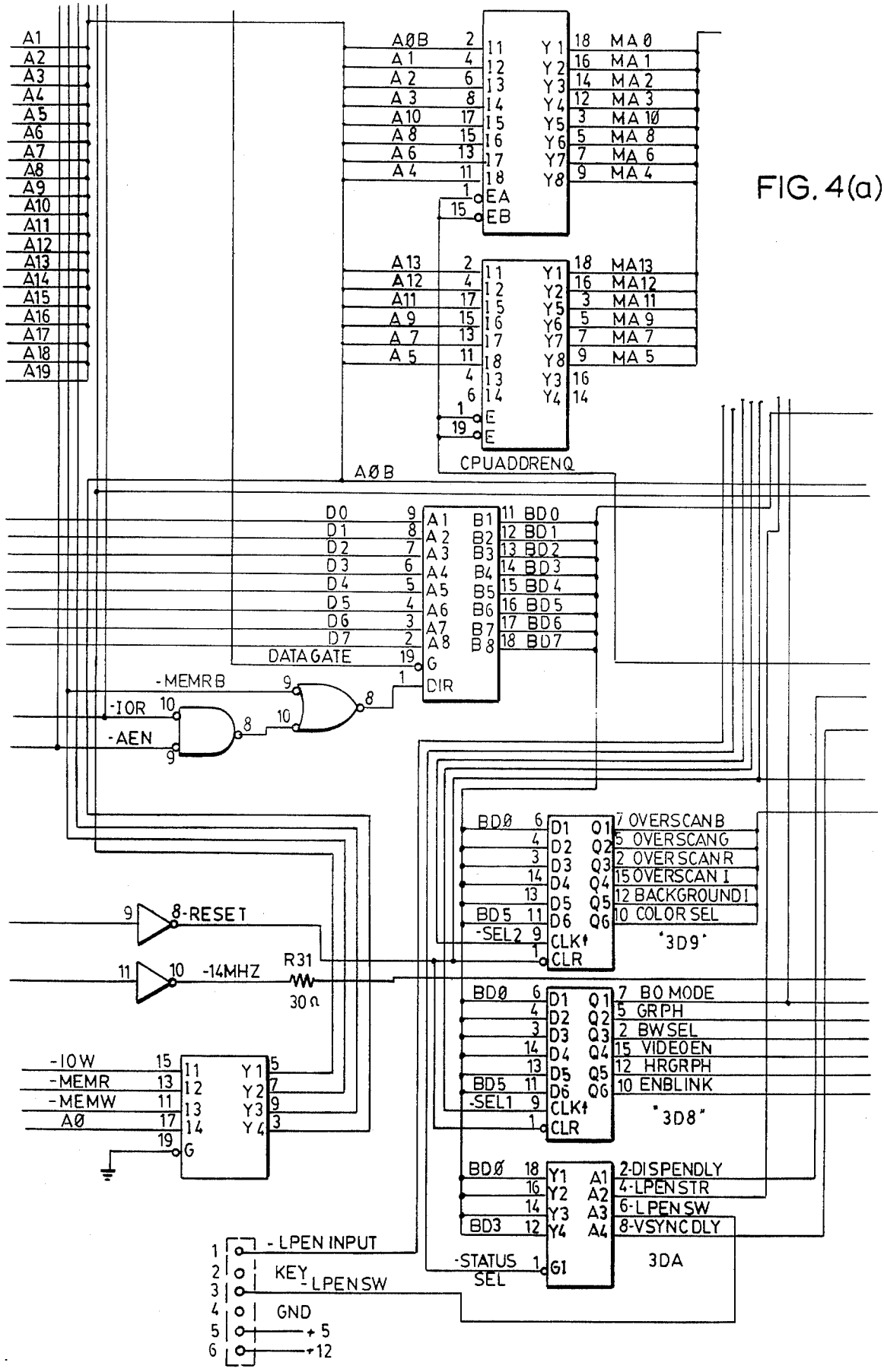
FIGS. 4(*a*)–(*h*), when arranged in accordance with FIG. 3, forms a detail circuit diagram of the internal monitor of the present invention as shown in FIG. 2.
Figure 4B:
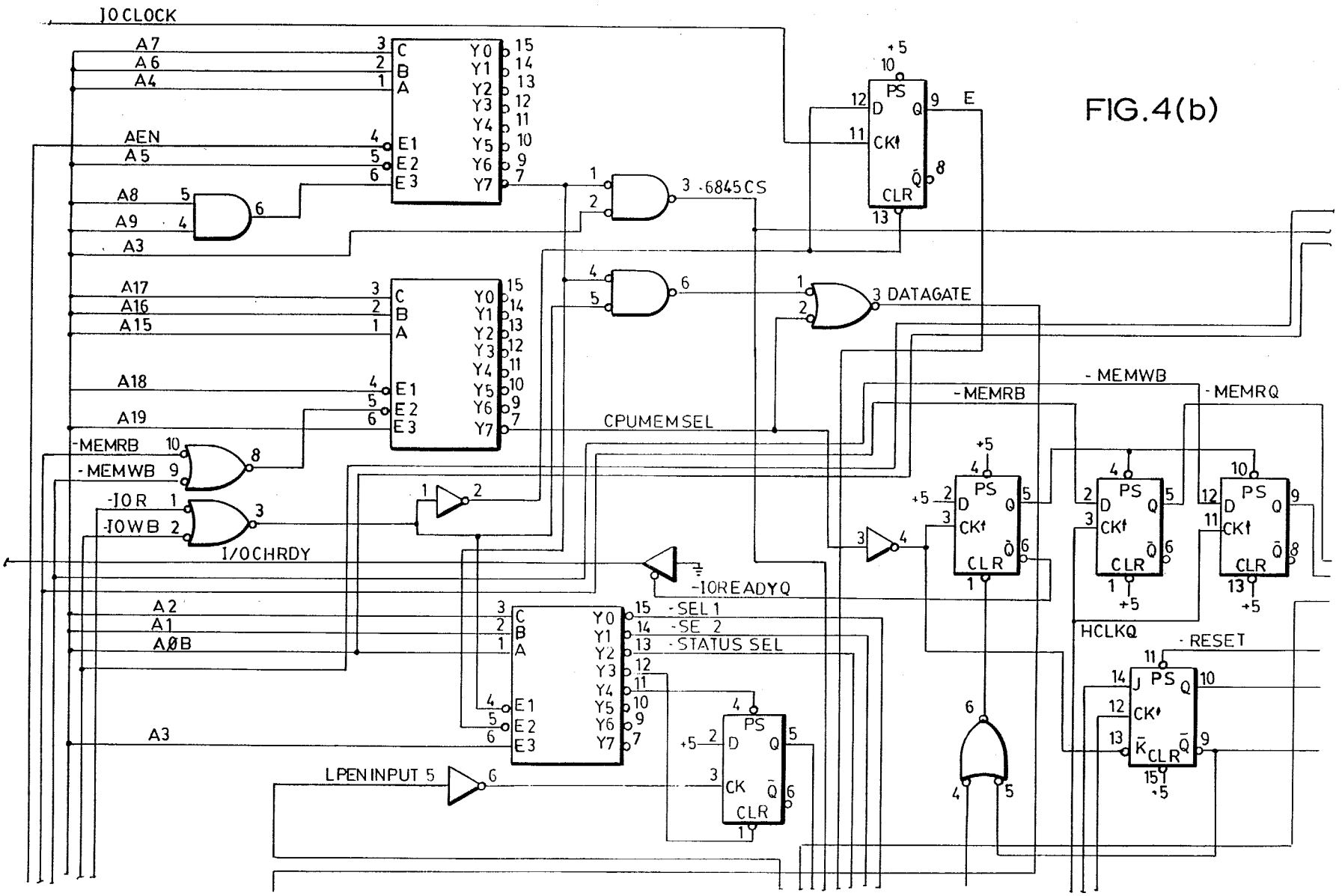
Figure 4:
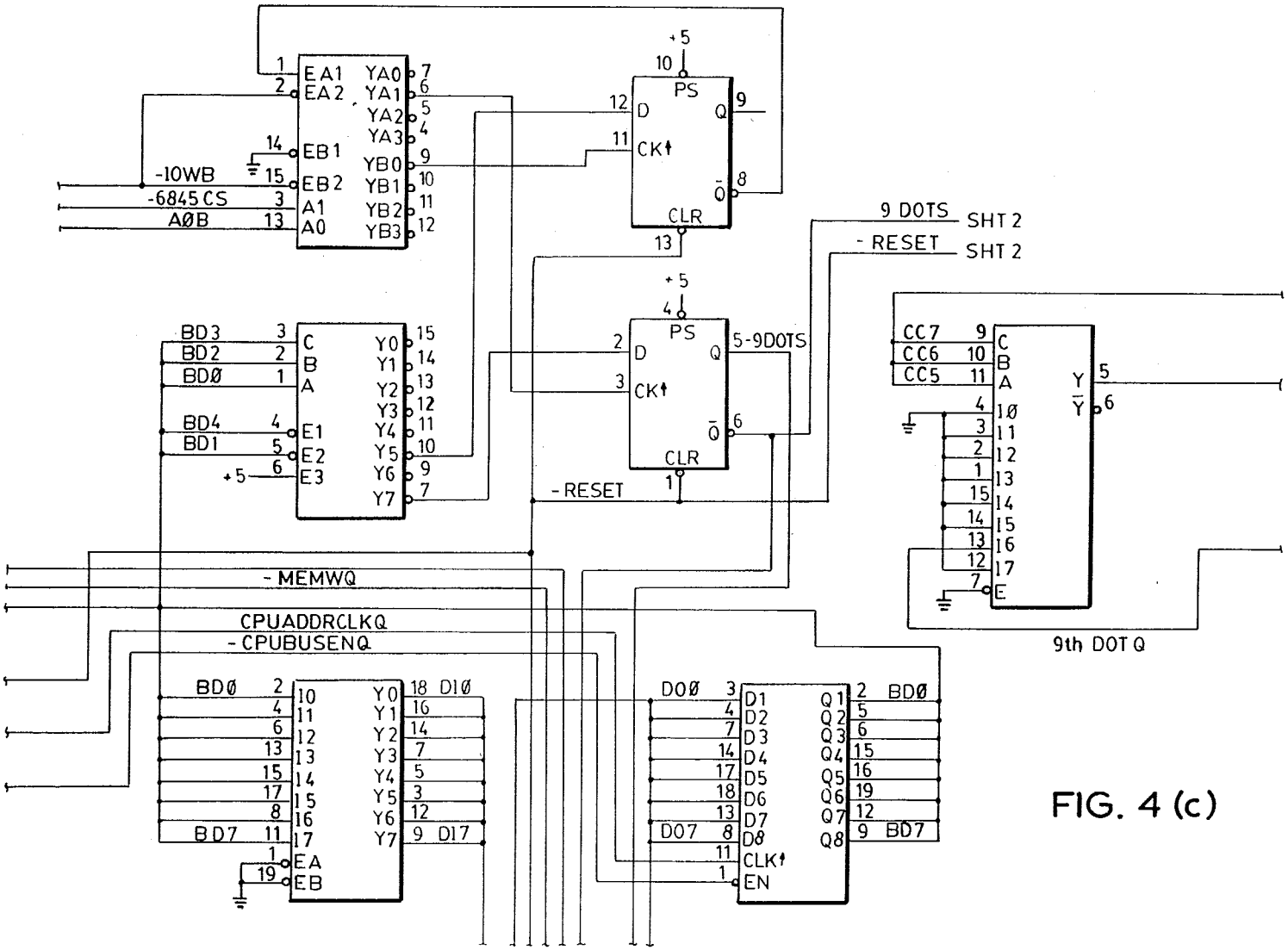
Figure 4D:
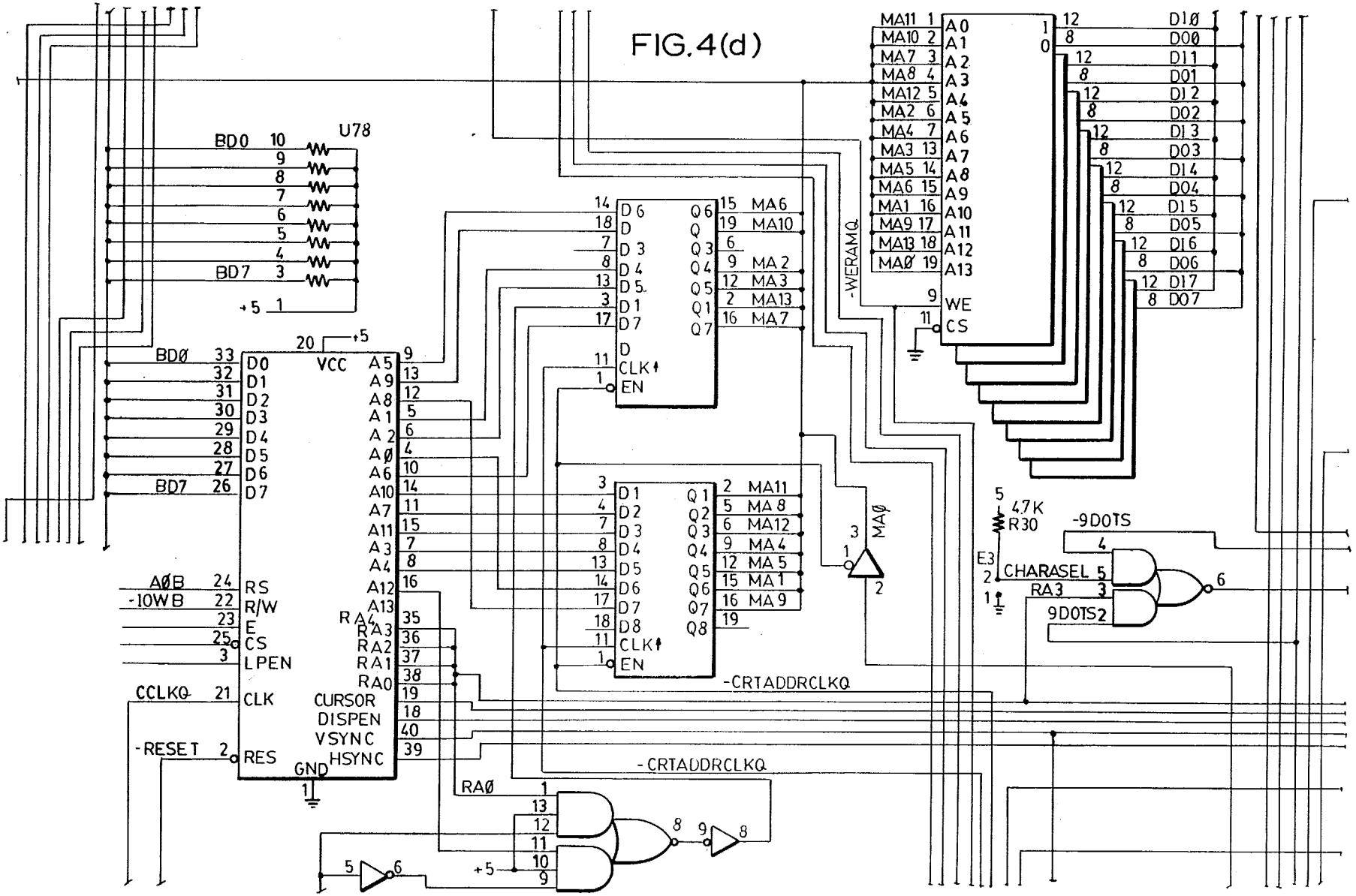
Figure 4E:
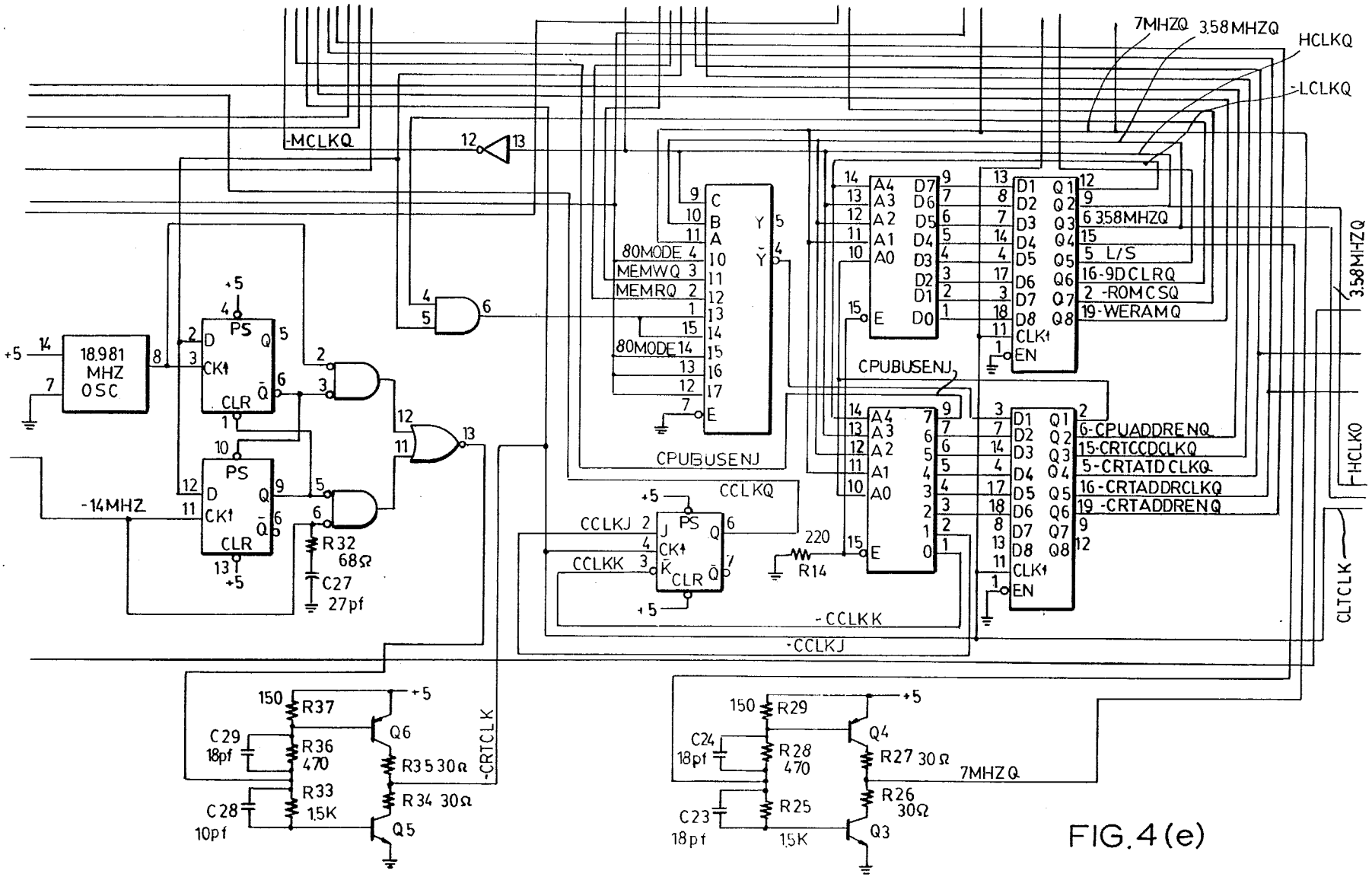
Figure 4F:
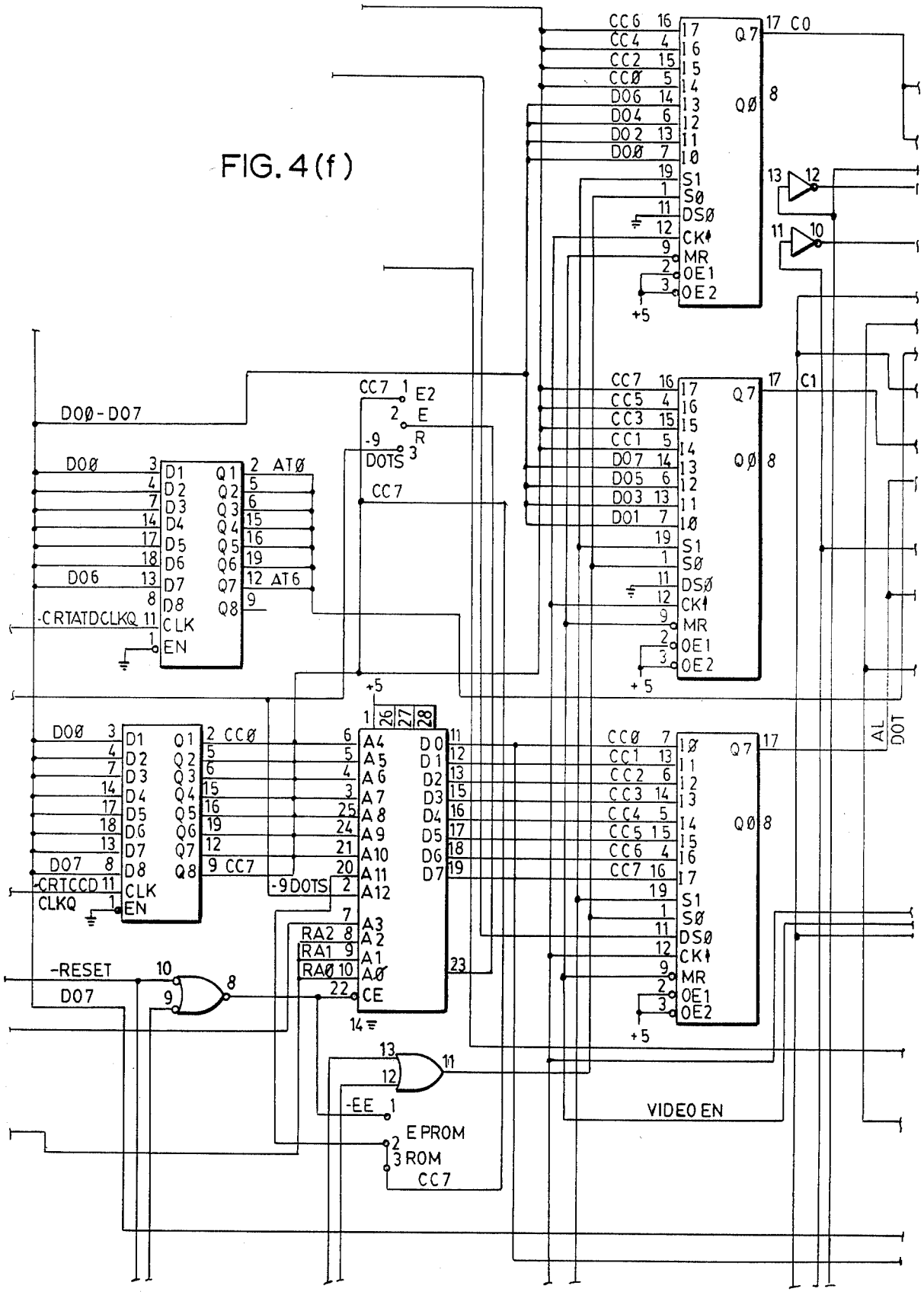
Figure 4:
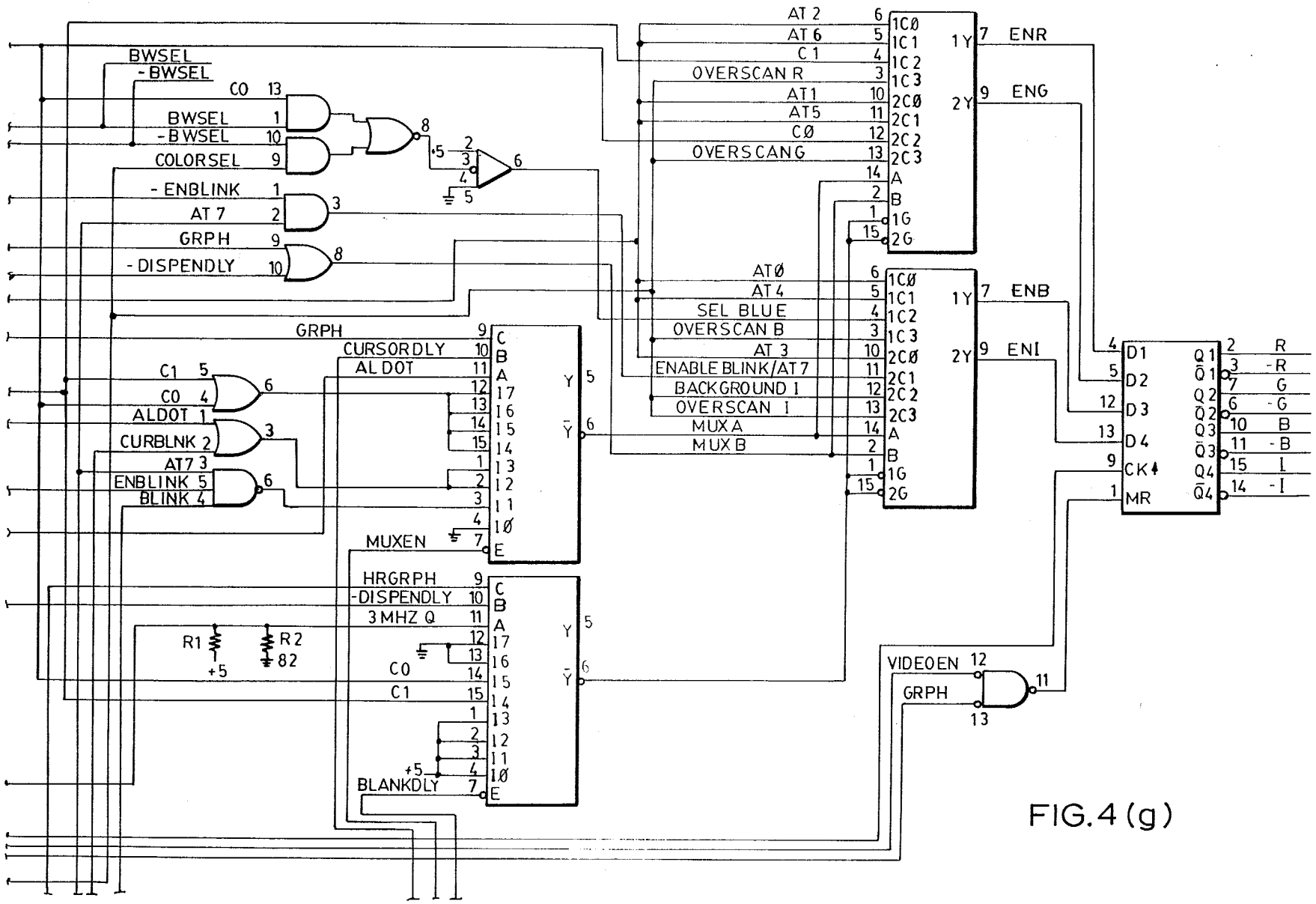
Figure 4:
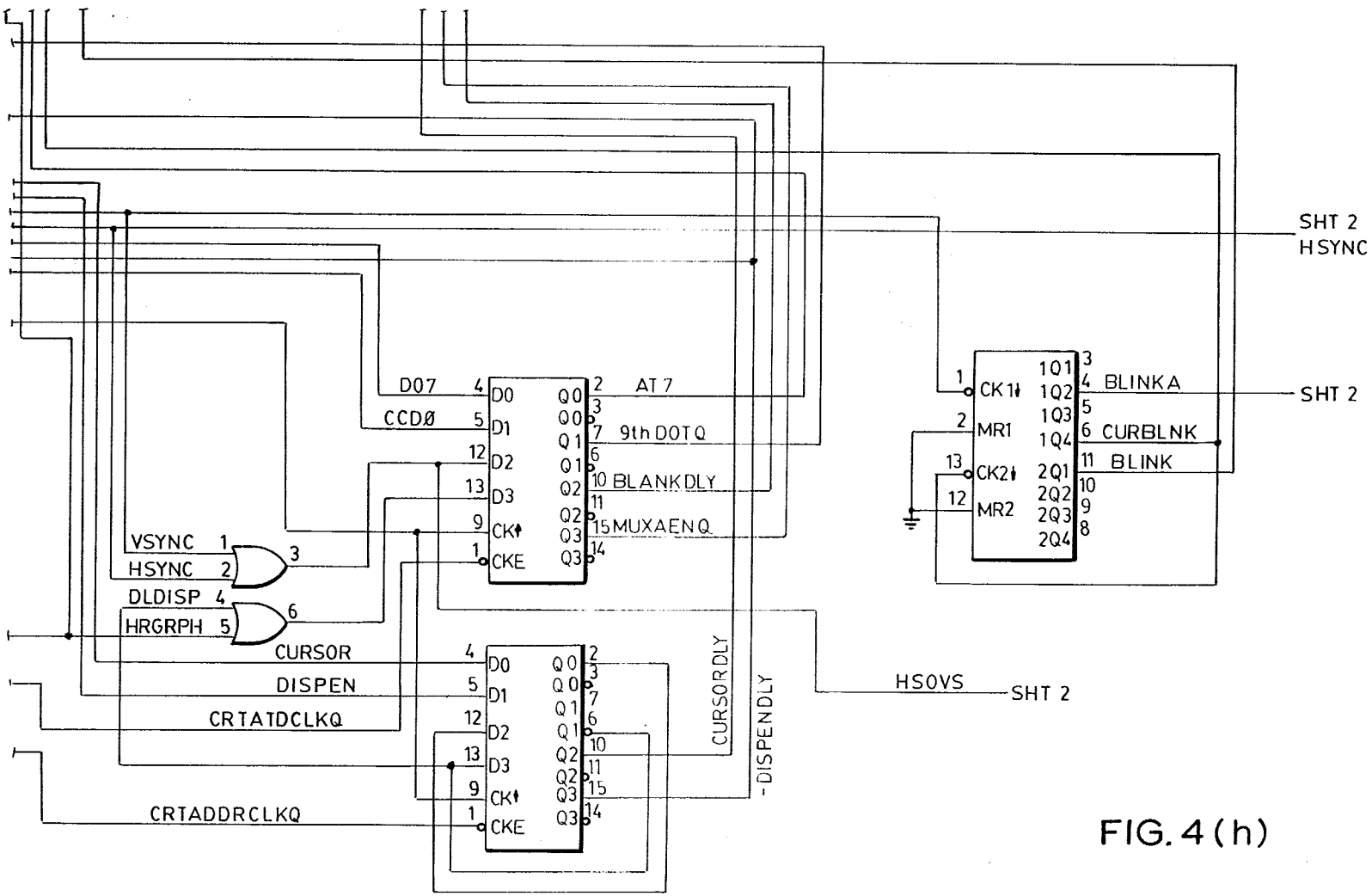
Figure 5A:
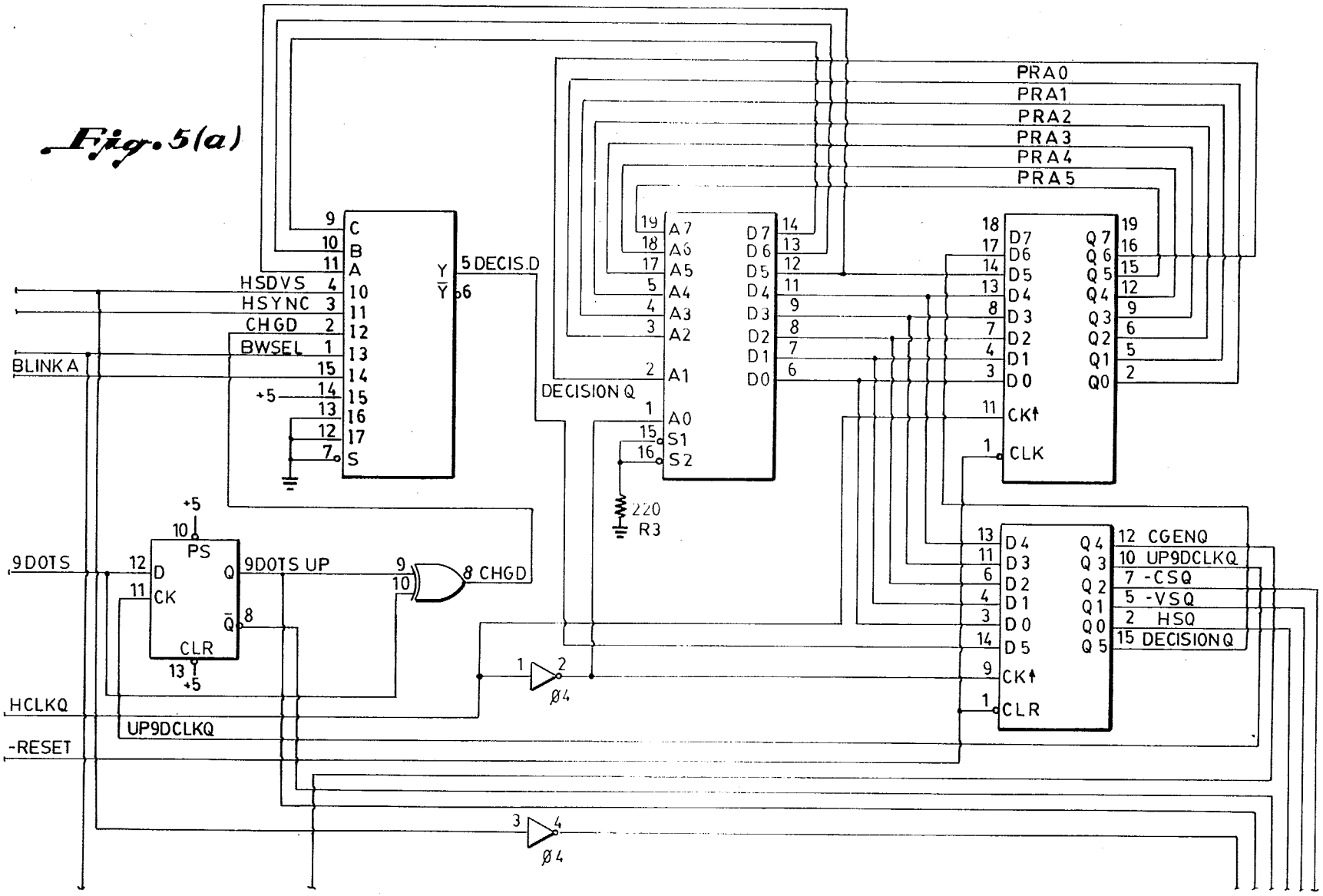
FIGS. 5(*a*), 5(*b*), 5(*c*), and 5(*d*), when FIG. 5(*a*) is positioned above FIG. 5(*c*) and the left of FIG. 5(*b*), with FIG. 5(*d*) below FIG. 5(*b*), forms FIG. 5, a detail circuit diagram of the internal monitor D/A and driver control, and RGB/C composite color generator of the present invention.
Figure 5B:
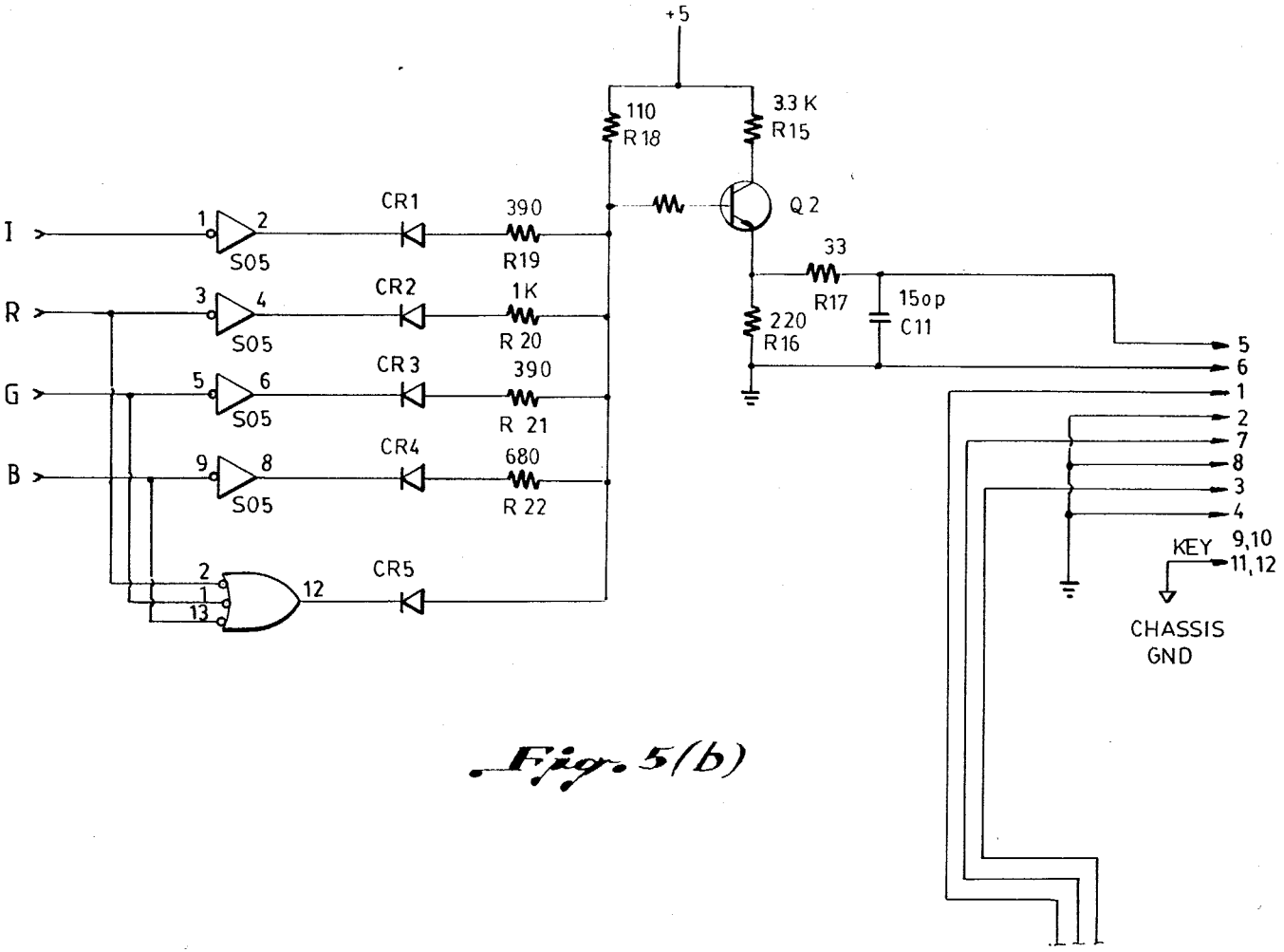
Figure 5:
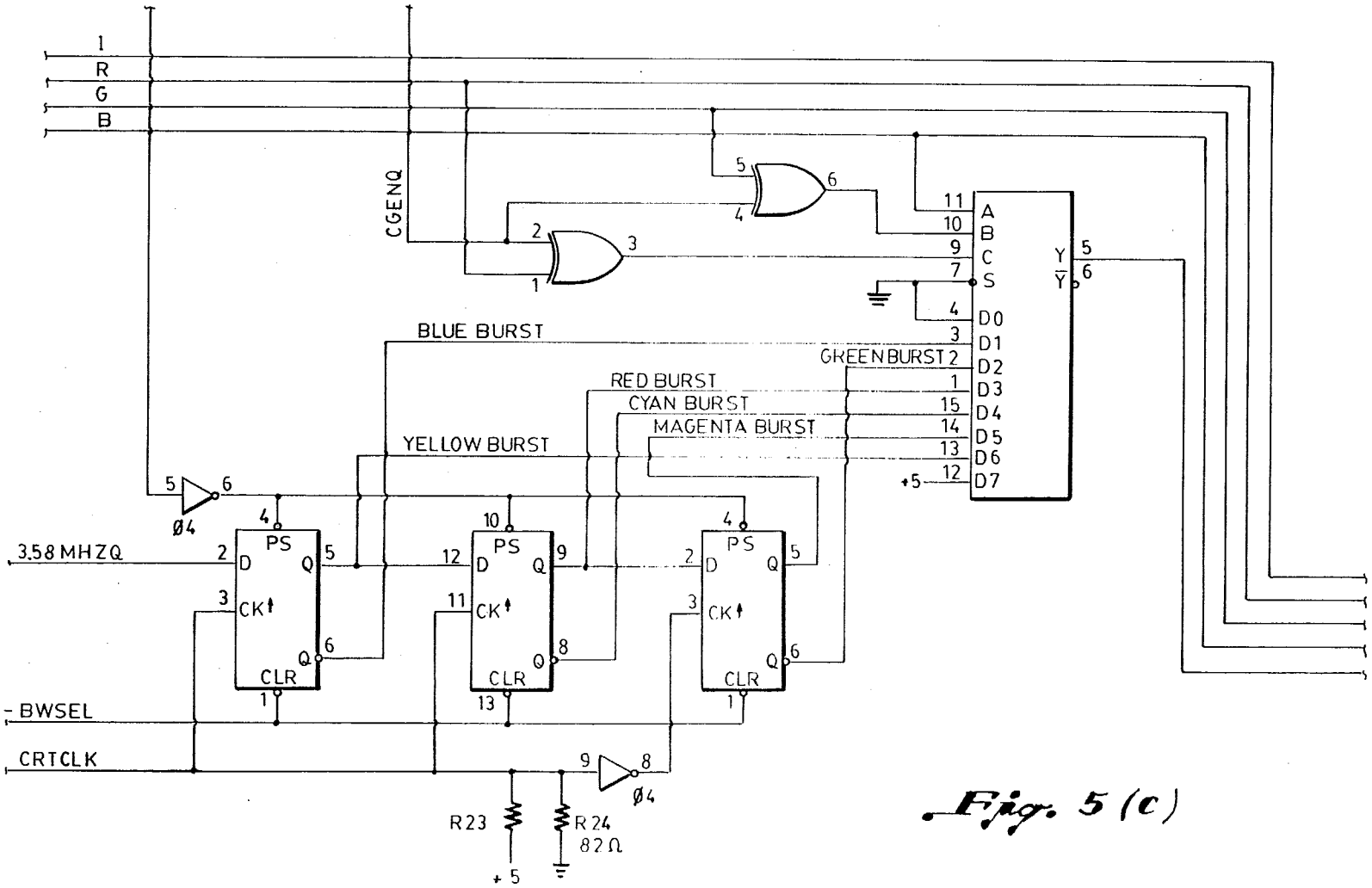
Figure 5D:
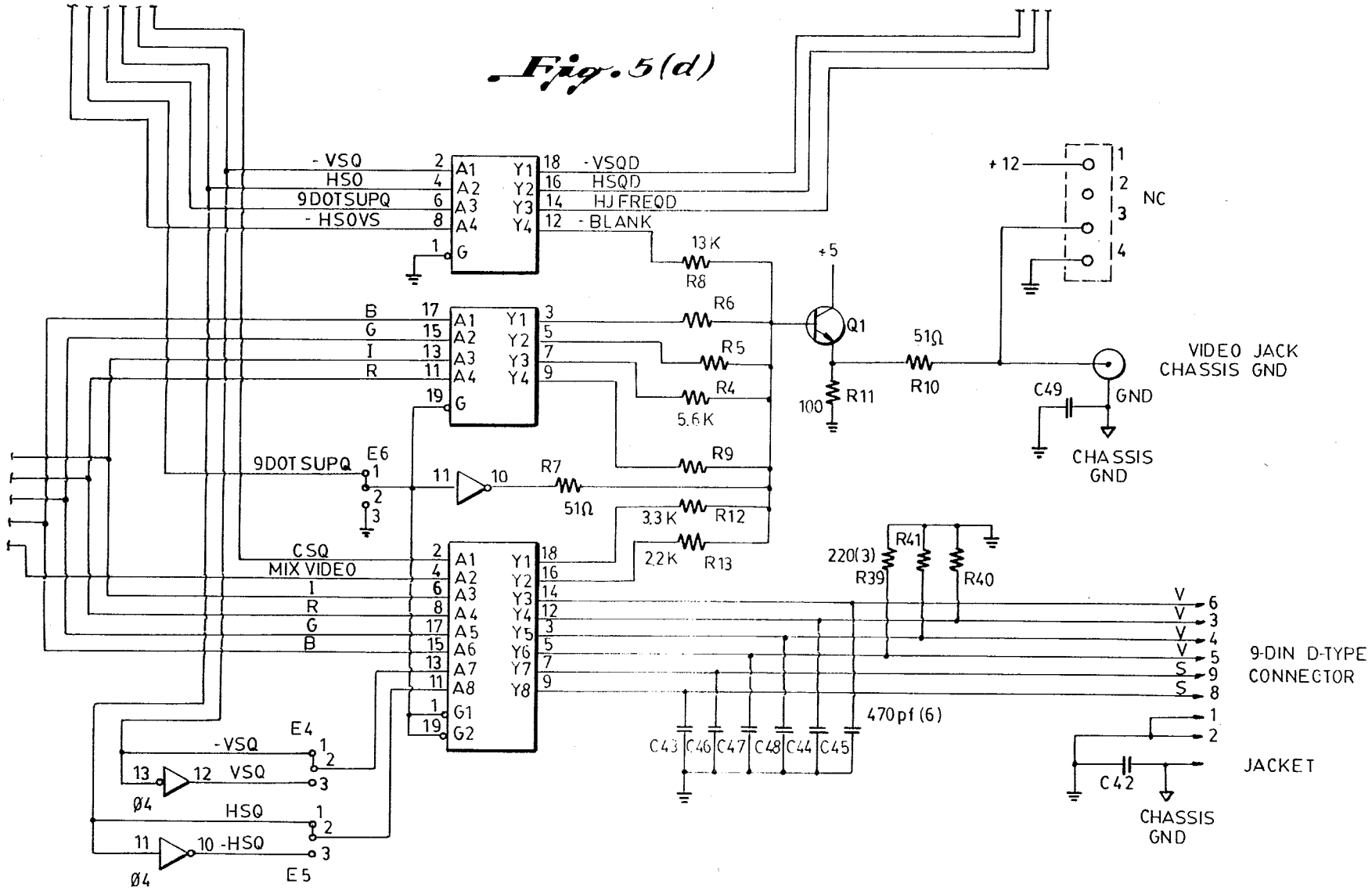

Turning now to FIGS. 4(*a*) through 4(*h*) and FIG. 5, there is shown a detail circuit diagram of the video controller of the present invention shown in FIG. 2 when FIGS. 4(*a*) through 4(*h*) are arranged in accordance with FIG. 3 and FIGS. 5(*a*) through 5(*d*) are arranged as described above to form FIG. 5. Those skilled in the art and having the benefit of these detailed circuit diagrams will appreciate and understand how these well known circuits operate. Accordingly, a detailed discussion of each individual circuit is not provided here. However, with reference to FIG. 5(*b*), there is shown a D/A driver control circuit which takes the R, G, B and I signals from the color encoder 84 and converts this code into an analog voltage for selecting a gray scale display in black and white on a black and white monitor 28. If a color graphics mode is selected, the video controller of the present invention creates an R, G, B and I output which can be applied to a color monitor which has an RGB interface for displaying color graphics. This circuit is illustrated in FIGS. 5(*a*), 5(*c*), and 5(*d*). Also illustrated in FIG. 5(*d*) are circuits for creating a composite video signal which can be applied directly to the internal video circuits of a color monitor or could be provided to a RF modulator for creating a standard broadcast TV signal for application to the antennae input leads of a color TV set. However, when the present invention is selecting the high resolution alphanumeric screen format, the color graphics output circuits are disabled, and only the output from the input monitor D/A and driver control 88 circuits (FIGS. 5(*a*) and 5(*b*), are outputted from the video controller board 10.

In summary, a video display system has been disclosed and described in which multiple selectable screen formats are available in a single display monitor for creating an image in a display field whose size is maintained constant where the number of scan lines in the selectable screen formats do not bear a binary relationship therebetween, and, where the selection between screen formats is done automatically without any external mechanical adjustments required to the circuits at the time of selection in order to obtain the constant display field size.

In describing the invention, reference has been made to a preferred embodiment, however, those skilled in the art and familiar with the disclosure of the invention may recognize additions, deletions, substitutions, or other modifications which would fall within the purview of the invention as defined appended claims.

What is claimed is:

1. A video display system responsive to mode select signals for displaying alphanumeric characters or graphic data in a display field of a video CRT screen having a height adjustment, the CRT operating from horizontal and vertical scan frequencies, the height of the display field determined by the screen format selected where the selected screen format includes a number of horizontal scan lines, the system including a means responsive, respectively, to first and second mode select signals for selecting a first screen format having a first number of horizontal scan lines and a second screen format having a second number of horizontal scan lines, where the height and width of the display field for both said first and second screen formats is the same, and where the first and second screen formats are generated, respectively, from first and second horizontal scan frequencies, said means adapted to generate said alphanumeric characters in either of said selected screen formats where said displayed characters are substantially identical in both said formats.

2. The display system of claim 1 wherein said means includes a means responsive to a third mode select signal when in said first screen format to double the number of horizontal scan lines in the display field without increasing the height of the display field by interleaving the horizontal scan lines and keeping the horizontal scan frequency the same.

3. The video system of claim 1 wherein each horizontal scan line in the display field for a selected screen format has a width which includes a number of pixel dots, said selecting means including a dot clock generator responsive, respectively, to the first and second mode select signals for generating first and second dot clocks for respectively outputting a first number of pixel dots per horizontal scan line in the first screen format and a second numbers of pixel dots per horizontal scan line in the second screen format where the width of the horizontal scan lines for both said first and second screen formats is the same.

4. The video system of claim 3 wherein each horizontal scan line in either said first or second screen format when displaying alphanumeric characters displays the same number of characters per scan line, each character appearing in an array of $n \times m$ dots formed from n consecutive dots from each horizontal scan line taken over m consecutive horizontal scan lines.

5. The video system of claim 4 wherein the determined number of characters displayed across the width of the display field for said first or second screen formats is 80 characters.

6. The video system of claim 1 wherein said means for selecting the screen formats includes:

(a) a means for generating a first vertical scan frequency for the first screen format and a second vertical scan frequency for the second screen format; and (b) a means for automatically adjusting the height control for the CRT screen in response to the mode control signals, said vertical scan frequency generating means and said height adjustment means cooperating to control the height of the display field to be the same for each selected screen format.

7. The video system of claim 6 wherein said first and second vertical scan frequencies are 60 and 50 Hz respectively.

8. The video system of claim 6 wherein said first and second vertical scan frequencies are 50 and 60 Hz, respectively.

9. The video system of claim 6 further including a means for generating a first horizontal scan frequency for the first screen format and a second horizontal frequency for the second screen format, each horizontal scan line controlled by the period of said horizontal scan frequency, and where a portion of said period is used to display the video in the display field, said selecting means controlling the ratio of the horizontal scan frequency period to the video display time for each horizontal scan line in both said first and second screen formats to be the same.

10. The video system of claim 9 wherein said first and second horizontal scan frequencies are, respectively, approximately 15.7 KHz and 18.5 KHz.

11. The video system of claim 9 wherein said first and second horizontal scan frequencies are, respectively, approximately 18.5 KHz and 15.7 KHz.

12. A video display system including a means for switching from a first screen format defining a display field having a height and a width in a CRT video display unit of a first number of horizontal scan lines developed with a first horizontal scan frequency to a second screen format having a second number of horizontal scan lines developed with a different horizontal scan frequency such that the display field remains the same size in both height and width, said display system further including an image generation means for generating a plurality of indicia in either of said screen formats, at least some of said indicia being substantially congruent in both said screen formats.

13. A personal computer having a CRT video display unit, said computer including a means responsive to first and second mode select signals for switching from a first screen format which defines a display field in the CRT of a first number of horizontal scan lines to a second screen format having the same size display field in both height and width formed from a second number of horizontal scan lines where said first and second screen formats are generated, respectively, from first and second horizontal scan frequencies, said means adapted to generate a plurality of indicia in either of said screen formats, at least some of said indicia in said first format similarly shaped to said indicia in said second format.

14. The personal computer of claim 13 wherein said means for selecting the screen formats includes:

(a) a means for generating a first vertical scan frequency for the first screen format and a second vertical scan frequency for the second screen format; and (b) a means for automatically adjusting the height control for the CRT screen in response to the mode control signals, said vertical scan frequency generating means and said height adjustment means co-operating to control the height of the display field to be the same for each selected screen format.

15. The personal computer of claim 14 further including a means for generating a first horizontal scan frequency for the first screen format and a second horizontal frequency for the second screen format, each horizontal scan line controlled by the period of said horizontal scan frequency, and where a portion of said period is used to display the video in the display field, said selecting means controlling the ratio of the horizontal scan frequency period to the video display time for each horizontal scan line to be equal in both said first and second screen formats.

16. The personal computer of claim 15 wherein said first and second horizontal scan frequencies are approximately 15.7 KHz and 18.5 KHz.

* * * * *